US008622534B2

(12) United States Patent
Bisson et al.

(10) Patent No.: US 8,622,534 B2
(45) Date of Patent: Jan. 7, 2014

(54) METHOD OF MINIMIZING KOGATION IN THERMAL INKJET PRINTHEADS

(75) Inventors: Adrian Bisson, Balmain (AU); Roger Michael Davey, Balmain (AU); Alexander Grant, Balmain (AU); Damon Donald Ridley, Balmain (AU); Kia Silverbrook, Balmain (AU); Steven Carter, Balmain (AU)

(73) Assignee: Zamtec Ltd, Dublin (IE)

( * ) Notice: Subject to any disclaimer, the term of this patent is extended or adjusted under 35 U.S.C. 154(b) by 276 days.

(21) Appl. No.: 12/701,602

(22) Filed: Feb. 8, 2010

(65) Prior Publication Data

US 2011/0193911 A1 Aug. 11, 2011

(51) Int. Cl.
*B41J 2/01* (2006.01)

(52) U.S. Cl.
USPC ..... 347/100; 347/95; 523/160

(58) Field of Classification Search
USPC ..... 347/100, 95, 96, 101, 54, 56, 20; 106/31.6, 31.13; 523/161, 160
See application file for complete search history.

(56) References Cited

U.S. PATENT DOCUMENTS

| | | | | |
|---|---|---|---|---|
| 5,281,261 | A * | 1/1994 | Lin | 106/31.65 |
| 5,877,234 | A * | 3/1999 | Xu et al. | 523/161 |
| 5,969,003 | A | 10/1999 | Foucher et al. | |
| 6,180,691 | B1 | 1/2001 | Cheng et al. | |
| 6,239,193 | B1 | 5/2001 | Cheng et al. | |
| 6,329,446 | B1 * | 12/2001 | Sacripante et al. | 523/161 |
| 7,176,249 | B2 * | 2/2007 | Akutsu et al. | 347/101 |
| 2002/0113842 | A1 * | 8/2002 | Katsuragi et al. | 347/56 |
| 2008/0152828 | A1 * | 6/2008 | Mukai et al. | 427/466 |
| 2009/0043028 | A1 * | 2/2009 | Matsuyama et al. | 524/377 |

FOREIGN PATENT DOCUMENTS

| | | | |
|---|---|---|---|
| EP | 1293546 | A2 | 3/2003 |
| GB | 2349153 | B | 10/2000 |
| WO | WO 2008/042320 | A1 | 4/2008 |

OTHER PUBLICATIONS

National Industrial Chemicals Notification and Assessment Scheme; Full Public Report; date: Jan. 30, 1991; Styrene-Acrylate Copolymer; Glass Transition Temperature: 55-65 degree C. (pp. 1-8).*

* cited by examiner

*Primary Examiner* — Manish S Shah
(74) *Attorney, Agent, or Firm* — Cooley LLP

(57) ABSTRACT

A method of minimizing kogation of a heater element in a thermal inkjet printhead. The method includes the steps of: (i) supplying an inkjet ink to a nozzle chamber of the printhead; and (ii) repeatedly actuating a heater element in the nozzle chamber so as to heat a portion of the ink to a temperature sufficient to form a bubble therein, thereby causing droplets of ink to be ejected from a nozzle opening associated with the nozzle chamber. The ink includes a styrene-acrylic copolymer having a glass transition temperature (Tg) in the range of 5 to 30° C. and acid value in the range of 100 180 mgKOH/g, said styrene-acrylic copolymer minimizes kogation of the heater element.

13 Claims, 3 Drawing Sheets

METHOD OF MINIMIZING KOGATION IN THERMAL INKJET PRINTHEADS

FIELD OF THE INVENTION

This invention relates to inkjet inks for thermal inkjet printers. It has been developed primarily for minimizing kogation of heater elements after repeated actuations.

CROSS REFERENCES

The following patents or patent applications filed by the applicant or assignee of the present invention are hereby incorporated by cross-reference.

| | | | | |
|---|---|---|---|---|
| 6,755,509 | 7,222,943 | 7,188,419 | 7,168,166 | 7,086,719 |
| 12/246,332 | 12/246,336 | 7,246,886 | 7,128,400 | 7,108,355 |
| 6,991,322 | 7,287,836 | 7,118,197 | 10/728,784 | 7,364,269 |
| 7,077,493 | 6,962,402 | 10/728,803 | 7,147,308 | 10/728,779 |
| 7,118,198 | 7,168,790 | 7,172,270 | 7,229,155 | 6,830,318 |
| 7,195,342 | 7,175,261 | 7,465,035 | 7,108,356 | 7,118,202 |
| 10/773,186 | 7,134,744 | 7,134,743 | 7,182,439 | 7,210,768 |
| 7,465,036 | 7,134,745 | 7,156,484 | 7,118,201 | 7,111,926 |
| 7,431,433 | 7,401,901 | 7,468,139 | 11/744,885 | 11/097,308 |
| 7,328,978 | 7,334,876 | 7,147,306 | 7,448,734 | 7,425,050 |
| 11/014,764 | 11/014,763 | 7,331,663 | 7,360,861 | 7,328,973 |
| 7,427,121 | 7,407,262 | 7,303,252 | 7,249,822 | 11/014,762 |
| 7,311,382 | 7,360,860 | 7,364,257 | 7,390,075 | 7,350,896 |
| 7,429,096 | 7,384,135 | 7,331,660 | 7,416,287 | 11/014,737 |
| 7,322,684 | 7,322,685 | 7,311,381 | 7,270,405 | 7,303,268 |
| 7,470,007 | 7,399,072 | 7,393,076 | 11/014,750 | 11/014,749 |
| 7,249,833 | 11/014,769 | 11/014,729 | 7,331,661 | 11/014,733 |
| 7,300,140 | 7,357,492 | 7,357,493 | 11/014,766 | 7,380,902 |
| 7,284,816 | 7,284,845 | 7,255,430 | 7,390,080 | 7,328,984 |
| 7,350,913 | 7,322,671 | 7,380,910 | 7,431,424 | 7,470,006 |
| 11/014,732 | 7,347,534 | 7,441,865 | 7,469,989 | 7,367,650 |
| 7,469,990 | 11/688,863 | 11/688,864 | 11/688,865 | 7,364,265 |
| 11/741,766 | 12/014,767 | 12/014,768 | 12/014,769 | 12/014,770 |
| 12/014,771 | 12/014,772 | 12/049,371 | 12/049,372 | 12/049,373 |
| 12/146,399 | 12/334,519 | 12/339,039 | 12/557,517 | 12/613,404 |

BACKGROUND OF THE INVENTION

Thermal bubble-forming inkjet printheads function by generating a certain amount of heat in a printing fluid contained in a nozzle chamber. This heat causes a bubble to form which eventually collapses as the fluid is forced through a nozzle. The collapse of the bubble then causes more fluid to enter the nozzle chamber for the same process to begin again.

The present Applicant has developed a range of thermal bubble-forming printheads. The Applicant's thermal bubble-forming printheads include those with suspended heater elements (as described in, for example, U.S. Pat. No. 6,755,509; U.S. Pat. No. 7,246,886; and U.S. Pat. No. 7,401,910, the contents of which are incorporated herein by reference) and those with embedded heater elements (as described in, for example, U.S. Pat. No. 7,377,623; U.S. Pat. No. 7,431,431; US 2006/250453; and U.S. Pat. No. 7,491,911, the contents of which are incorporated herein by reference). Other designs of thermal bubble-forming printheads, such as those available from Canon and Hewlett-Packard, will be known to the person skilled in art.

Inkjet inks for thermal bubble-forming printhead are typically water-based ink formulations comprising a pigment-based or dye-based colorant. A problem in virtually all thermal inkjet printheads is the build of solid deposits on heater elements used to heat the ink—a phenomenon known in the art as 'kogation'. Kogation is problematic, because it reduces the efficiency of heater elements, but kogation may also cause nozzle failure. Inkjet inks comprising dispersions of pigments are usually more prone to kogation, although kogation can still be a problem in dye-based inks, and particularly any inks comprising polymer additives.

The problem of kogation has been addressed by various means in the prior art. In some inkjet printers, kogation is addressed through the use of non-ejecting drive pulses which disrupt kogative deposits on the heater elements sufficiently so that the deposits may be cleared. U.S. Pat. No. 5,440,330 and US2007/052761 describe the use of specific pulse voltages, pulse widths, pulse frequencies etc, which are useful in removing kogation. However, such approaches have limited success and may not be useful in removing all types of kogation.

EP-A-1302321 describes a printhead specifically designed to address the problem of kogation. Each ink ejection device comprises two chambers separated by a flexible membrane, whereby a first chamber is used to generate a bubble and a second chamber ejects ink. A pressure wave, which is transmitted from the first chamber through the flexible membrane to the second chamber, causes droplet ejection. An advantage of this arrangement is that a simple non-kogating fluid (e.g. water) can be used in the first chamber so that the heater element is free of kogation. However, the device is complex and necessarily occupies a larger area of the printhead than conventional bubble-forming chambers.

Other approaches to reducing kogation in the prior art employ additives in the inkjet inks. For example, US 2002/113842 describes the use of aldonic acid additives (e.g. gluconic acid) in pigment-based inks. Both self-dispersing pigments and pigments dispersed with polymeric dispersants are described. However, kogation was reported to be high in all cases in the absence of the aldonic acid additive.

EP-A-1279707 describes the use of organophosphonic acid additives for reducing kogation.

US 2008/066644 describes the use of amine additives in combination with two surfactants for reducing kogation.

U.S. Pat. No. 6,616,273 describes the addition of copper salts to inks, which delivers copper ions to heater elements to aid in the removal of kogation.

U.S. Pat. No. 4,790,880 describes the addition of crown ethers to inks in order to reduce kogation and improve print quality.

WO97/31984 describes pigment-based inkjet inks containing a vinyl silicone polymer, which is reported to reduce kogation.

It would be desirable to provide a new means for minimizing kogation of heater elements by inkjet inks, particularly pigment-based inkjet inks.

SUMMARY OF THE INVENTION

In a first aspect, there is provided a method of minimizing kogation of a heater element in a thermal inkjet printhead, the method comprising the steps of:

(i) supplying an inkjet ink to at least one nozzle chamber of the printhead; and (ii) actuating a heater element in the nozzle chamber so as to heat a portion of the ink to a temperature sufficient to form a bubble therein, thereby causing droplets of ink to be ejected from a nozzle opening associated with the nozzle chamber, wherein the ink comprises an acrylic polymer having a glass transition temperature ($T_g$) of less than about 100° C., the acrylic polymer minimizing kogation of the heater element.

The present invention achieves minimal kogation by formulating inkjet inks with a specific type of acrylic polymer as described herein.

Optionally, the heater element is actuated at least 10 million times, or optionally at least 20 million times, and exhibits less kogation compared to an ink in which the acrylic polymer is absent. Inks according to the present invention exhibit less kogation than comparable inks which are polymer-free and inks which contain an acrylic polymer having a glass transition temperature ($T_g$) of about 100° C. or more.

The ink comprises a colorant, which may be a pigment or a dye. Optionally, the ink comprises a pigment, which may be a self-dispersing and/or surface-modified pigment. In other words, the ink may comprise a pigment, which does not require any polymeric dispersants in order to be dispersed in an aqueous ink vehicle.

Optionally, the acrylic polymer is an olefin-acrylic copolymer, such as a styrene-acrylic copolymer.

Optionally, the styrene-acrylic copolymer has a $T_g$ of less than about 90° C. Optionally, the styrene-acrylic copolymer has a $T_g$ in the range of about 0 to 60° C., or optionally in the range of about 10 to 50° C.

Optionally, the styrene-acrylic copolymer has an acid value in the range of 100 to 300 mgKOH/g, or optionally, in the range of 100 to 180 mgKOH/g.

Optionally, the ink vehicle is an aqueous-based ink vehicle, which typically contains at least 50 wt % water.

Optionally, the ink vehicle comprises at least one solvent present in an amount ranging from 5 wt % to 40 wt %.

Optionally, the ink vehicle comprises at least one surfactant present in an amount ranging from 0.1 wt % to 5 wt %.

Optionally, the at least one solvent is selected from the group consisting of: ethylene glycol, glycerol and 2-pyrollidone. For example, the solvent may comprise a mixture of ethylene glycol, glycerol and 2-pyrollidone.

Optionally, the pigment is present in an amount ranging from 0.01 to 25 wt %, optionally from 0.1 to 10 wt %.

Optionally, the acrylic polymer is present in an amount ranging from 0.1 to 15 wt %, or optionally from 0.2 to 10 wt %, or optionally from 0.5 to 5 wt %.

In a second aspect, there is provided a use of an acrylic polymer additive in an inkjet ink for minimizing kogation of a heater element in a thermal inkjet printhead, wherein the acrylic polymer has a glass transition temperature ($T_g$) of less than about 100° C. Various optional embodiments of the second aspect may be in accordance with those optional embodiments described above in connection with the first aspect.

In a third aspect, there is provided an inkjet ink for minimizing kogation of a heater element in a thermal inkjet printhead, the ink comprising:

an ink vehicle;

a self-dispersing colorant; and a styrene-acrylic copolymer having a glass transition temperature ($T_g$) of less than about 100° C.

Inkjet inks according to the third aspect were hitherto unknown, because self-dispersing colorants, by their very nature, do not require any polymeric dispersants in order to be formulated into inkjet inks. However, the use of certain acrylic polymers to aid reduction of kogation means that inks according to the third aspect provide significant advantages over inks having no acrylic polymers present.

Optionally, the self-dispersing colorant is a surface-modified pigment. Optionally, the surface-modified pigment comprises surface sulfonate groups or surface carboxylate groups. The pigment may be black, cyan, magenta, yellow, red, green, blue, infra-red absorbing etc.

Various other optional embodiments of the third aspect may be in accordance with those optional embodiments described above in connection with the first aspect.

In a fourth aspect, there is provided an ink cartridge for a thermal inkjet printhead, the ink cartridge containing the inkjet ink according to the third aspect. The thermal inkjet printhead may be integrated with the ink cartridge according to the fourth aspect.

In a fifth aspect, there is provided an inkjet printer comprising a thermal inkjet printhead in fluid communication with an ink reservoir containing the inkjet ink according to the third aspect.

Optionally, the thermal inkjet printhead comprises a plurality of nozzle chambers containing the ink, each nozzle chamber comprising a heater element suspended or embedded in the nozzle chamber, the heater element being configured for heating a portion of the ink to a temperature sufficient to form a bubble and thereby eject a droplet of the ink from the nozzle chamber. An example of a thermal inkjet printhead having a suspended heater element is described herein. Other types of thermal inkjet printhead will be well known to the person skilled in the art.

BRIEF DESCRIPTION OF THE DRAWINGS

Optional embodiments of the present invention will now be described by way of example only with reference to the accompanying drawings, in which:—

DETAILED DESCRIPTION OF THE INVENTION

Figure 1:
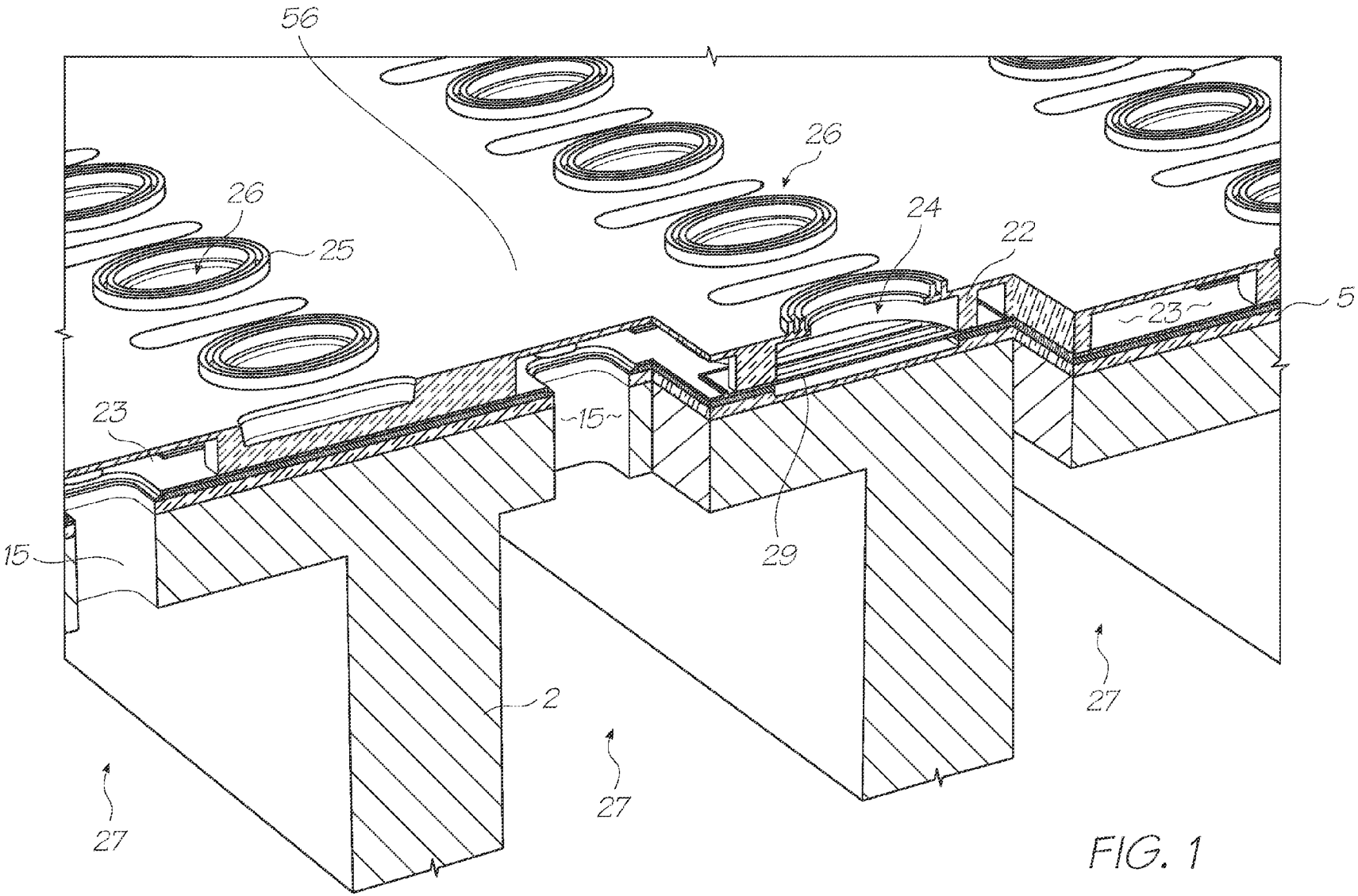
FIG. 1 is a perspective view of part of a thermal inkjet printhead.

As used herein, the term "acrylic polymer" is used to mean any type of acrylic polymer resin, including acrylic homopolymers, acrylic copolymers, acrylic terpolymers etc. Acrylic polymers may be formed from any suitable acrylic monomers, such as acrylic acid, methacrylic acid, acrylate, methacrylate etc.

The present invention employs inkjet inks comprising an acrylic polymer having a glass transition temperature ($T_g$) of less than about 100° C. Such acrylic polymers have been shown by the present Applicants to be useful in minimizing kogation of heater elements in thermal inkjet printheads. Hitherto, it was understood that kogation of heater elements was caused primarily by non-volatile polymer dispersants which are included in many inkjet inks. Polymeric dispersants are typically added to inkjet inks in order to aid in the dispersion of pigments. It is indeed surprising that the inclusion of a specific type of acrylic polymer reduces kogation of heater elements when compared to inks which do not contain such acrylic polymers and/or inks which are free of any polymer additives. Visual comparisons of heater elements after at least 10 million droplet ejections or at least 20 million droplet ejections show a remarkable difference for inks employed in the present invention and inks which are polymer-free. In particular, significantly less kogation is observed when the ink contains an acrylic polymer having a $T_g$ of less than about 100° C. when compared to inks which are polymer-free. This is a very surprising result given that polymers were hitherto believed to be one of the major caused of kogation in thermal inkjet printheads.

The present invention may be used in connection with any type of ink, such as dye-based inks or pigment-based inks. However, the reduction of kogation is most advantageous in pigment-based inks.

In the case of conventional pigment-based inks, acrylic polymers having a glass transition temperature ($T_g$) of less than about 100° C. may be used for both dispersing the pigments and reducing kogation. In other words, the use of such acrylic polymers obviates any need for the addition of further kogation-reducing additives, because the acrylic polymer functions as a dispersant for conventional pigments and simultaneously minimizes kogation.

In the case of self-dispersing colorants (which typically do not require any polymeric dispersants), the addition of acrylic polymers having a glass transition temperature ($T_g$) of less than about 100° C. may be used solely for reducing kogation. Self-dispersing colorants include both dyes and surface-modified pigments, both of which will be well known to the person skilled in the art. Each component of inkjet inks used in the present invention will now be described in more detail.

Acrylic Polymer

The acrylic polymer is typically an acrylic copolymer, such as an olefin-acrylic copolymer. Styrene-acrylic copolymers are most preferred.

The glass transition temperature ($T_g$) of the acrylic polymer is less than 100° C., optionally less than 90° C., and optionally less than 60° C. Optimal kogation results are observed when the acrylic polymer is a styrene-acrylic polymer having a $T_g$ in the range of 0 to 50° C. or, optionally, 5 to 30° C.

The acrylic polymer typically has an acid value in the range of 100 to 300 mgKOH/g or, optionally, in the range of 100 to 180 mgKOH/g.

The acrylic polymer may have a molecular weight in the range of 3000 to 15,000 g/mol.

Joncryl® HPD 296 and Joncryl® ECO 684 (available from BASF) are two examples of styrene acrylic copolymers, which may be used in the present invention.

The acrylic polymer is typically present in the ink in an amount range from 0.1 wt % to 15 wt %, optionally from 0.2 wt % to 10 wt %, or optionally from 0.5 wt % to 5 wt %.

Colorant

As noted above, the colorant may be either a dye-based colorant or a pigment-based colorant, although reduction of kogation is most advantageous with pigments. Dyes and surface-modified pigments are self-dispersing colorants in the sense that they do not require any polymeric dispersants in order to be dispersed into a typical ink vehicle. Novel inkjet inks according to the present invention comprise a self-dispersing colorant, the acrylic polymer described above and an ink vehicle.

Inkjet colorants will be well-known to the person skilled in the art and the method of reducing kogation according to the present invention is not limited to any particular type of dye or pigment.

Conventional pigments suitable for use in the method of the present invention may be inorganic pigments or organic pigments. Examples are carbon black, Cadmium Red, Molybdenum Red, Chrome Yellow, Cadmium Yellow, Titan Yellow, chromium oxide, Viridian, Titan Cobalt Green, Ultramarine Blue, Prussian Blue, Cobalt Blue, diketopyrrolo-pyrrole, anthraquinone, benzimidazolone, anthrapyrimidine, azo pigments, phthalocyanine pigments (including naphthlocyanine pigments), uinacridone pigments, isoindolinone pigments, dioxazine pigments, indanthrene pigments, perylene pigments, perinone pigments, thioindigo pigments, quinophthalone pigments, and metal complex pigments. Some specific examples of pigments are Pigment 15:3, Pigment V19, Pigment Y151 and Pigment PK-7.

Dyes suitable for use in the present invention include azo dyes, metal complex dyes, naphthol dyes, anthraquinone dyes, indigo dyes, carbonium dyes, quinone-imine dyes, xanthene dyes, cyanine dyes, quinoline dyes, nitro dyes, nitroso dyes, benzoquinone dyes, naphthoquinone dyes, phthalocyanine dyes (including naphthalocyanine dyes), and metal phthalocyanine dyes (including metal naphthalocyanine dyes). Some specific examples of dyes are Solvent red 8, Solvent blue 70, Solvent yellow 82 and Solvent black 27.

Surface-modified pigments are pigments, which have been modified with a surface anionic group or a surface cationic group. Typical surface-modifying groups are carboxylate and sulfonate groups. Formula (i) shows a carboxylate-modified black pigment, while formula (ii) shows a sulfonate-modified color pigment. However, other surface-modifying groups may also be used, such as anionic phosphate groups or cationic ammonium groups.

(i)

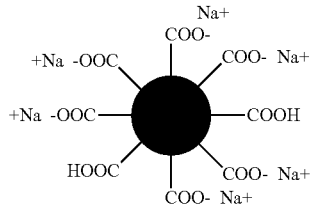

(ii)

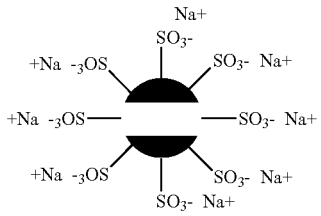

Specific examples of suitable aqueous surface-modified pigment dispersions for use in the present invention are Sensijet® Black SDP 2000 (available from Sensient Colors Inc.) and CAB-O-JET® 200, 300, 250C, 260M and 270Y (available from Cabot Corporation).

The pigments and dyes can be used in inkjet inks either individually or as a combination of two or more thereof.

The average particle size of pigment particles in inkjet inks is optionally in the range of 50 to 500 nm.

Ink Vehicle

Ink vehicles for inkjet inks will be well known to the person skilled in the art and the ink vehicles used in the present invention are not particularly limited. The present Applicant has recently described non-aqueous inkjet inks for thermal inkjet printheads (see U.S. application Ser. No. 12/577,517 filed on Sep. 11, 2009, the contents of which are herein incorporated by reference), and such non-aqueous inks are also within the ambit of the present invention. Non-aqueous ink vehicles for use in thermal inkjets typically comprise a N—($C_{1-6}$ alkyl)-2-pyrrolidinone (e.g. N-methyl-2-pyrrolidinone) and a $C_{1-6}$ alcohol (e.g. ethanol).

However, the ink vehicles used in the present invention are typically conventional aqueous ink vehicles comprising at least 40 wt % water, at least 50 wt % water or at least 60 wt % water. Usually, the amount of water present in the inkjet ink is in the range of 50 wt % to 90 wt %, or optionally in the range of 60 wt % to 80 wt %.

Aqueous inkjet inks compositions are well known in the literature and, in addition to water, may comprise other components, such as co-solvents (including humectants, penetrants, wetting agents etc.), surfactants, biocides, sequestering agents, pH adjusters, viscosity modifiers, etc.

Co-solvents are typically water-soluble organic solvents. Suitable water-soluble organic solvents include $C_{1-4}$alkyl alcohols, such as ethanol, methanol, butanol, propanol, and 2-propanol; glycol ethers, such as ethylene glycol monomethyl ether, ethylene glycol monoethyl ether, ethylene glycol monobutyl ether, ethylene glycol monomethyl ether acetate, diethylene glycol monomethyl ether, diethylene glycol monoethyl ether, diethylene glycol mono-n-propyl ether, ethylene glycol mono-isopropyl ether, diethylene glycol mono-isopropyl ether, ethylene glycol mono-n-butyl ether, diethylene glycol mono-n-butyl ether, triethylene glycol mono-n-butyl ether, ethylene glycol mono-t-butyl ether, diethylene glycol mono-t-butyl ether, 1-methyl-1-methoxybutanol, propylene glycol monomethyl ether, propylene glycol monoethyl ether, propylene glycol mono-t-butyl ether, propylene glycol mono-n-propyl ether, propylene glycol mono-isopropyl ether, dipropylene glycol monomethyl ether, dipropylene glycol monoethyl ether, dipropylene glycol mono-n-propyl ether, dipropylene glycol mono-isopropyl ether, propylene glycol mono-n-butyl ether, and dipropylene glycol mono-n-butyl ether; formamide, acetamide, dimethyl sulfoxide, sorbitol, sorbitan, glycerol monoacetate, glycerol diacetate, glycerol triacetate, and sulfolane; or combinations thereof.

Other useful water-soluble organic solvents, which may be used as co-solvents, include polar solvents, such as 2-pyrrolidone, N-methylpyrrolidone, ϵ-caprolactam, dimethyl sulfoxide, sulfolane, morpholine, N-ethylmorpholine, 1,3-dimethyl-2-imidazolidinone and combinations thereof.

The inkjet ink may contain a high-boiling water-soluble organic solvent as a co-solvent, which can serve as a wetting agent or humectant for imparting water retentivity and wetting properties to the ink composition. Such a high-boiling water-soluble organic solvent includes one having a boiling point of 180° C. or higher. Examples of the water-soluble organic solvent having a boiling point of 180° C. or higher are ethylene glycol, propylene glycol, diethylene glycol, pentamethylene glycol, trimethylene glycol, 2-butene-1,4-diol, 2-ethyl-1,3-hexanediol, 2-methyl-2,4-pentanediol, tripropylene glycol monomethyl ether, dipropylene glycol monoethyl glycol, dipropylene glycol monoethyl ether, dipropylene glycol monomethyl ether, dipropylene glycol, triethylene glycol monomethyl ether, tetraethylene glycol, triethylene glycol, diethylene glycol monobutyl ether, diethylene glycol monoethyl ether, diethylene glycol monomethyl ether, tripropylene glycol, polyethylene glycols having molecular weights of 2000 or lower, 1,3-propylene glycol, isopropylene glycol, isobutylene glycol, 1,4-butanediol, 1,3-butanediol, 1,5-pentanediol, 1,6-hexanediol, glycerol, erythritol, pentaerythritol and combinations thereof.

Other suitable wetting agents or humectants include saccharides (including monosaccharides, oligosaccharides and polysaccharides) and derivatives thereof (e.g. maltitol, sorbitol, xylitol, hyaluronic salts, aldonic acids, uronic acids etc.)

The inkjet ink may also contain a penetrant, as one of the co-solvents, for accelerating penetration of the aqueous ink into the recording medium. Suitable penetrants include polyhydric alcohol alkyl ethers (glycol ethers) and/or 1,2-alkyldiols. Examples of suitable polyhydric alcohol alkyl ethers are ethylene glycol monomethyl ether, ethylene glycol monoethyl ether, ethylene glycol monobutyl ether, ethylene glycol monomethyl ether acetate, diethylene glycol monomethyl ether, diethylene glycol monoethyl ether, ethylene glycol mono-n-propyl ether, ethylene glycol mono-isopropyl ether, diethylene glycol mono-isopropyl ether, ethylene glycol mono-n-butyl ether, diethylene glycol mono-n-butyl ether, triethylene glycol mono-n-butyl ether, ethylene glycol mono-t-butyl ether, diethylene glycol mono-t-butyl ether, 1-methyl-1-methoxybutanol, propylene glycol monomethyl ether, propylene glycol monoethyl ether, propylene glycol mono-t-butyl ether, propylene glycol mono-n-propyl ether, propylene glycol mono-isopropyl ether, dipropylene glycol monomethyl ether, dipropylene glycol monoethyl ether, dipropylene glycol mono-n-propyl ether, dipropylene glycol mono-isopropyl ether, propylene glycol mono-n-butyl ether, and dipropylene glycol mono-n-butyl ether. Examples of suitable 1,2-alkyldiols are 1,2-pentanediol and 1,2-hexanediol. The penetrant may also be selected from straight-chain hydrocarbon diols, such as 1,3-propanediol, 1,4-butanediol, 1,5-pentanediol, 1,6-hexanediol, 1,7-heptanediol, and 1,8-octanediol. Glycerol may also be used as a penetrant.

Typically, the amount of co-solvent present in the ink is in the range of about 5 wt % to 40 wt %, or optionally 10 wt % to 30 wt %. A specific example of a co-solvent system, which may be used in the present invention, comprises ethylene glycol, 2-pyrrolidone and glycerol.

The inkjet ink may also contain a surface active agent ("surfactant"), such as an anionic surface active agent and/or a nonionic surface active agent. Useful anionic surface active agents include sulfonic acid types, such as alkanesulfonic acid salts, α-olefinsulfonic acid salts, alkylbenzenesulfonic acid salts, alkylnaphthalenesulfonic acids, acylmethyltaurines, and dialkylsulfosuccinic acids; alkylsulfuric ester salts, sulfated oils, sulfated olefins, polyoxyethylene alkyl ether sulfuric ester salts; carboxylic acid types, e.g., fatty acid salts and alkylsarcosine salts; and phosphoric acid ester types, such as alkylphosphoric ester salts, polyoxyethylene alkyl ether phosphoric ester salts, and glycerophosphoric ester salts. Specific examples of the anionic surface active agents are sodium dodecylbenzenesulfonate, sodium laurate, and a polyoxyethylene alkyl ether sulfate ammonium salt.

Examples of nonionic surface active agents include ethylene oxide adduct types, such as polyoxyethylene alkyl ethers, polyoxyethylene alkylphenyl ethers, polyoxyethylene alkyl esters, and polyoxyethylene alkylamides; polyol ester types, such as glycerol alkyl esters, sorbitan alkyl esters, and sugar alkyl esters; polyether types, such as polyhydric alcohol alkyl ethers; and alkanolamide types, such as alkanolamine fatty acid amides. Specific examples of nonionic surface active agents are ethers such as polyoxyethylene nonylphenyl ether, polyoxyethylene octylphenyl ether, polyoxyethylene dodecylphenyl ether, polyoxyethylene alkylallyl ether, polyoxyethylene oleyl ether, polyoxyethylene lauryl ether, and polyoxyalkylene alkyl ethers (e.g. polyoxyethylene alkyl ethers); and esters, such as polyoxyethylene oleate, polyoxyethylene oleate ester, polyoxyethylene distearate, sorbitan laurate, sorbitan monostearate, sorbitan mono-oleate, sorbitan sesquioleate, polyoxyethylene mono-oleate, and polyoxyethylene stearate. Acetylene glycol surface active agents, such as 2,4,7,9-tetramethyl-5-decyne-4,7-diol, 3,6-dimethyl-4-octyne-3,6-diol or 3,5-dimethyl-1-hexyn-3-ol, may also be used.

The surfactant is typically present in the aqueous inkjet ink in an amount ranging from 0.1 wt % to 10 wt %, or optionally in the range of 0.2 wt % to 5 wt %. A specific example of a nonionic surfactant, which may be used in the present invention, is Surfynol® 465 (available from Air Products and Chemicals, Inc)

The aqueous inkjet ink may also include a pH adjuster, such as sodium hydroxide, potassium hydroxide, lithium hydroxide, sodium carbonate, sodium hydrogencarbonate, potassium carbonate, potassium hydrogencarbonate, lithium carbonate, sodium phosphate, potassium phosphate, lithium phosphate, potassium dihydrogenphosphate, dipotassium hydrogenphosphate, sodium oxalate, potassium oxalate, lithium oxalate, sodium borate, sodium tetraborate, potassium hydrogenphthalate, and potassium hydrogentartrate; ammonia; and amines, such as methylamine, ethylamine, diethylamine, trimethylamine, triethylamine, tris(hydroxymethyl)aminomethane hydrochloride, triethanolamine, diethanolamine, diethylethanolamine, triisopropanolamine, butyldiethanolamine, morpholine, and propanolamine.

The aqueous inkjet ink may also include a biocide, such as benzoic acid, dichlorophene, hexachlorophene, sorbic acid, hydroxybenzoic esters, sodium dehydroacetate, 1,2-benthiazolin-3-one, 3,4-isothiazolin-3-one or 4,4-dimethyloxazolidine.

The aqueous inkjet ink may also contain a sequestering agent, such as ethylenediaminetetraacetic acid (EDTA).

Thermal Inkjet Printheads

The inkjet inks described herein minimize kogation in thermal inkjet printheads. There now follows a brief description of one of the Applicant's thermal inkjet printheads, as described in U.S. Pat. No. 7,303,930, the contents of which is herein incorporated by reference.

Figure 2:
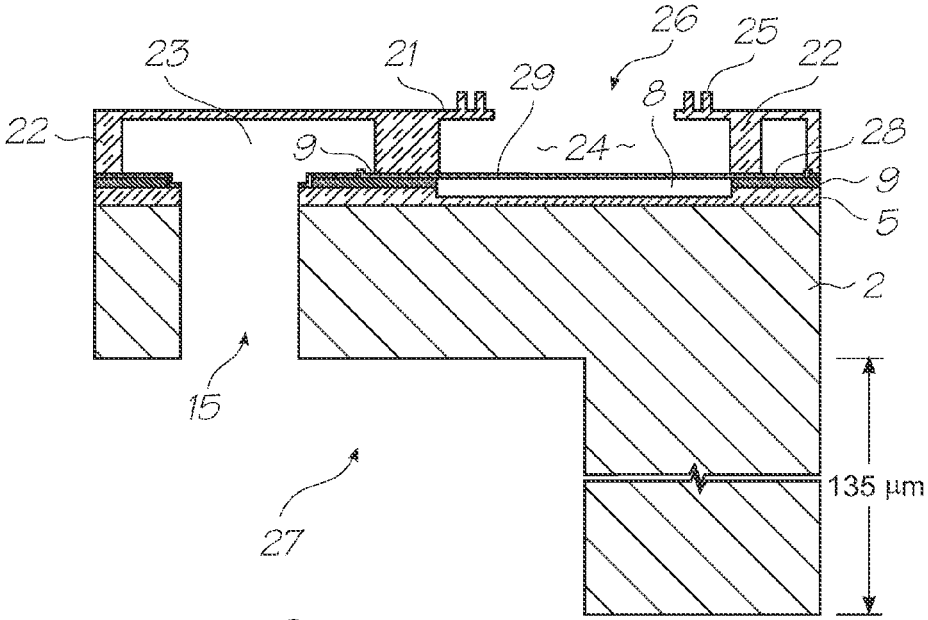
FIG. 2 is a side view of one of the nozzle assemblies shown in FIG. 1.
Figure 3:
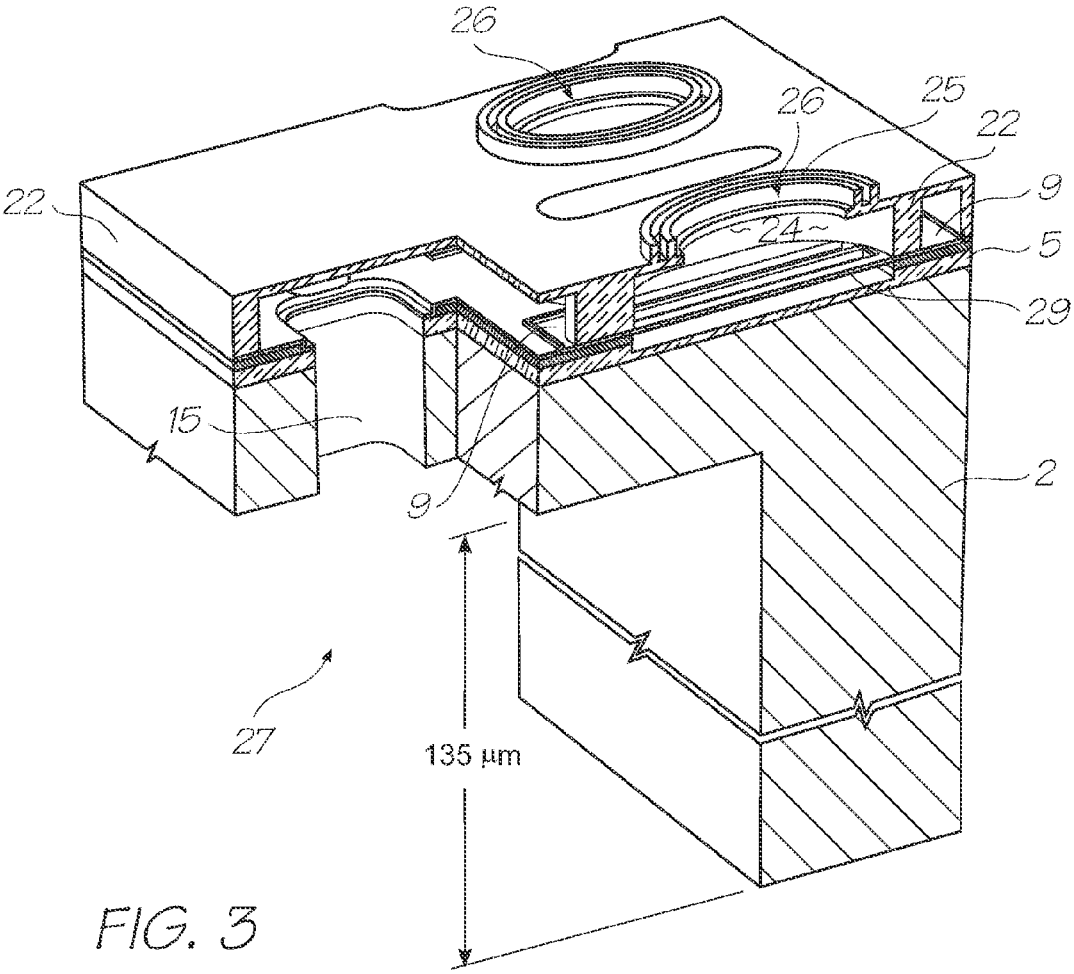
FIG. 3 is a perspective of the nozzle assembly shown in FIG. 2.

Referring to FIG. 1, there is shown part of printhead comprising a plurality of nozzle assemblies. FIGS. 2 and 3 show one of these nozzle assemblies in side-section and cutaway perspective views.

Each nozzle assembly comprises a nozzle chamber 24 formed by MEMS fabrication techniques on a silicon wafer substrate 2. The nozzle chamber 24 is defined by a roof 21 and sidewalls 22 which extend from the roof 21 to the silicon substrate 2. As shown in FIG. 1, each roof is defined by part of a nozzle plate 56, which spans across an ejection face of the printhead. The nozzle plate 56 and sidewalls 22 are formed of the same material, which is deposited by PECVD over a sacrificial scaffold of photoresist during MEMS fabrication. Typically, the nozzle plate 56 and sidewalls 21 are formed of a ceramic material, such as silicon dioxide or silicon nitride. These hard materials have excellent properties for printhead robustness, and their inherently hydrophilic nature is advantageous for supplying ink to the nozzle chambers 24 by capillary action.

Returning to the details of the nozzle chamber 24, it will be seen that a nozzle opening 26 is defined in a roof of each nozzle chamber 24. Each nozzle opening 26 is generally elliptical and has an associated nozzle rim 25. The nozzle rim 25 assists with drop directionality during printing as well as reducing, at least to some extent, ink flooding from the nozzle opening 26. The actuator for ejecting ink from the nozzle chamber 24 is a heater element 29 positioned beneath the nozzle opening 26 and suspended across a pit 8. Current is supplied to the heater element 29 via electrodes 9 connected to drive circuitry in underlying CMOS layers of the substrate 2. When a current is passed through the heater element 29, it rapidly superheats surrounding ink to form a gas bubble, which forces ink through the nozzle opening 26. By suspending the heater element 29, it is completely immersed in ink when the nozzle chamber 24 is primed. This improves printhead efficiency, because less heat dissipates into the underlying substrate 2 and more input energy is used to generate a bubble.

As seen most clearly in FIG. 1, the nozzles are arranged in rows and an ink supply channel 27 extending longitudinally along the row supplies ink to each nozzle in the row. The ink supply channel 27 delivers ink to an ink inlet passage 15 for each nozzle, which supplies ink from the side of the nozzle opening 26 via an ink conduit 23 in the nozzle chamber 24.

The MEMS fabrication process for manufacturing such printheads was described in detail in U.S. Pat. No. 7,303,930, the contents of which are herein incorporated by reference.

The operation of printheads having suspended heater elements is described in detail in the Applicant's U.S. Pat. No. 7,278,717, the contents of which are incorporated herein by reference.

The Applicant has also described thermal bubble-forming inkjet printheads having embedded heater elements. Such printheads are described in, for example, U.S. Pat. No. 7,246,876 and US 2006/0250453, the contents of which are herein incorporated by reference.

The Applicant's thermal inkjet printheads may be generally characterized by having one or more of the following features: (i) suspended heater element; (ii) heater element having a mass of less than 1 nanogram, optionally less than 500 picograms; (iii) actuation energy of less than 500 nJ, optionally less than 200 nJ; and (iv) titanium nitride or titanium aluminium nitride heater element.

The inkjet inks described herein may be used in combination with the Applicant's thermal inkjet printheads, as described above, in order to minimize kogation. However, the use of such inks is not limited to the Applicant's thermal printheads and they may also be used in conventional thermal inkjet printheads, such as those sold commercially by Hewlett-Packard and Canon.

In the case of conventional scanning thermal inkjet printheads (or, indeed, the Applicant's pagewidth printheads), the present invention may relate to an ink cartridge for a inkjet printer comprising an inkjet ink as described herein. The ink cartridge may optionally comprise a thermal inkjet printhead integrated therewith.

For the sake of completeness, printers incorporating the Applicant's thermal inkjet printheads are described in, for example, U.S. Pat. No. 7,201,468; U.S. Pat. No. 7,360,861; U.S. Pat. No. 7,380,910; and U.S. Pat. No. 7,357,496, the contents of each of which are herein incorporated by reference.

Figure 4:
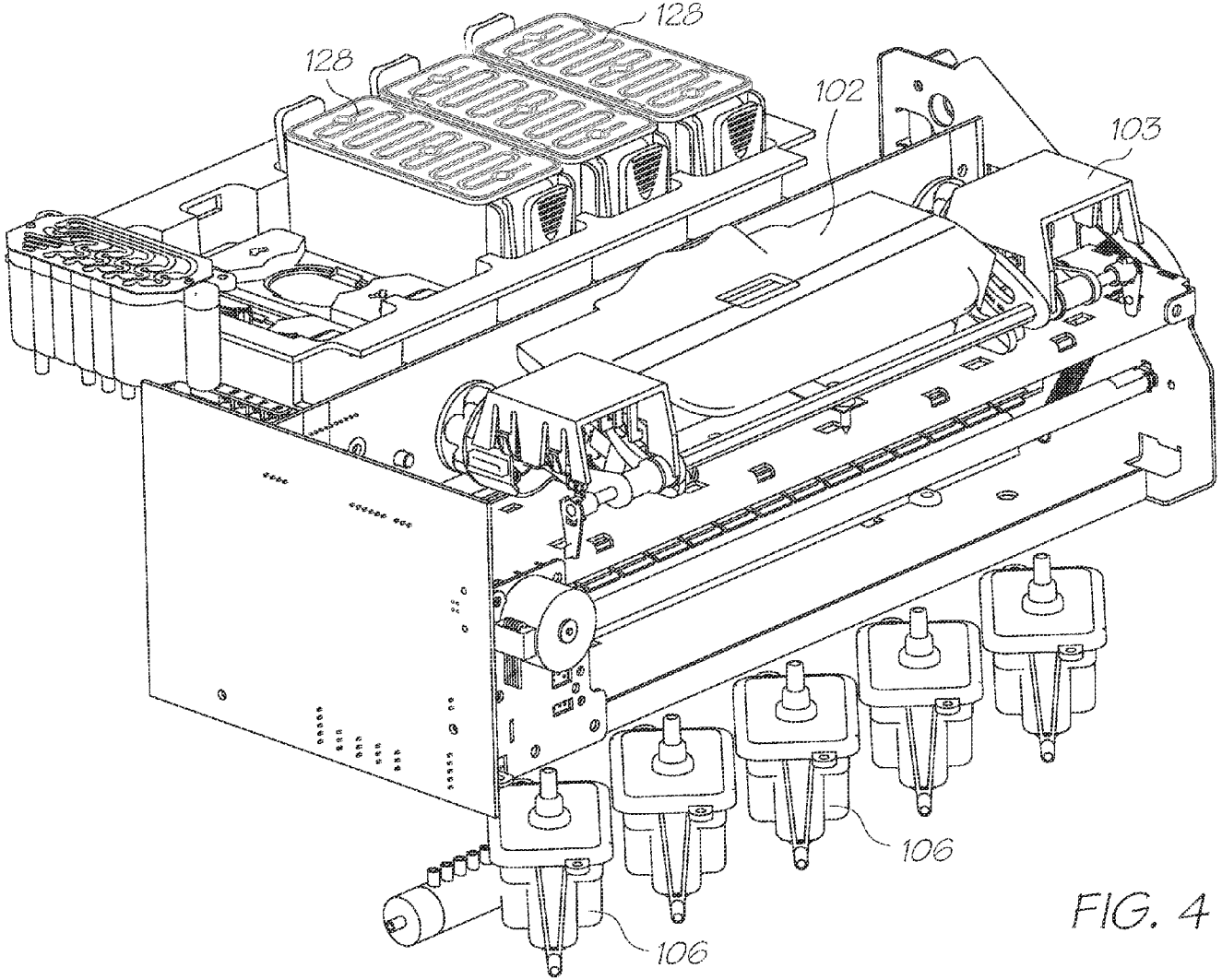
FIG. 4 is perspective view of a thermal inkjet print engine.

FIG. 4 shows a print engine 103 for a thermal inkjet printer, as described in Applicant's U.S. application Ser. No. 12/062,514, the contents of which is herein incorporated by reference. The print engine 103 includes a removable print cartridge 102, comprising a pagewidth printhead, and a bank of user-replaceable ink cartridges 128. Each color channel typically has its own ink reservoir 128 and a corresponding pressure-regulating chamber 106 for regulation of a hydrostatic pressure of ink supplied to the printhead. Hence, the print engine 103 has five ink reservoirs 128 and five corresponding pressure-regulating chambers 106. Typical color channel configurations for this five-channel print engine 103 are CMYKK or CMYK(IR). Each ink cartridge 128 may comprise an inkjet ink as described herein.

Although fluidic connections between the various components are not shown in FIG. 4, it will be appreciated that these connections are made with suitable hoses in accordance with the fluidics system described in, for example, U.S. application Ser. No. 12/062,514.

Experimental

The inks described in Tables 1 and 2 were formulated according to a general formulation process as follows:

(1) Co-solvent(s) were weighed into a suitable vessel before the addition of surfactant and water to provide a colourless ink vehicle.

(2) The colourless ink vehicle was allowed to stir for 10 minutes.

(3) The polymer was added to the stirred ink vehicle (with the exception of Comparative Example 1).

(4) The resulting solution was allowed to stir for a further 5 minutes before the addition of the surface-modified pigment.

(5) The formulation was allowed to stir for 15 minutes before filtration to 0.3 microns. The inks were filtered using a Pall Profile II 1" segment filter and the inks were recirculated for 15 minutes before passing into a washed vessel.

TABLE 1

| Inks comprising acrylic polymer having $T_g$ < 100° C. | | | | | |
|---|---|---|---|---|---|
| | Type | Example 1 | Example 2 | Example 3 | Example 4 |
| ethylene glycol | co-solvent | 10 parts | 22 parts | 10 parts | 10 parts |
| 2-pyrollidinone | co-solvent | 9 parts | | 9 parts | 9 parts |
| glycerol | co-solvent | 3 parts | | 3 parts | 3 parts |
| SDP2000[a] | pigment | 5 parts | 5 parts | 5 parts | 5 parts |
| Surfynol ® 465 | surfactant | 0.5 parts | 0.5 parts | 0.5 parts | 0.5 parts |
| Joncryl ® HPD296[b] | polymer | 3 parts | 3 parts | 1 parts | |
| Joncryl ® ECO684[b] | polymer | | | | 1 part |
| water | water | 69.5 parts | 69.5 parts | 71.5 parts | 71.5 parts |

TABLE 2

| Inks without acrylic polymer having $T_g$ <100° C. | | | | | | | |
|---|---|---|---|---|---|---|---|
| | Type | Comp. Ex. 1 | Comp. Ex. 2 | Comp. Ex. 3 | Comp. Ex. 4 | Comp. Ex. 5 | Comp. Ex. 6 |
| ethylene glycol | co-solvent | 10 parts | 10 parts | 10 parts | 10 parts | 10 parts | 10 parts |
| 2-pyrollidinone | co-solvent | 9 parts | 9 parts | 9 parts | 9 parts | 9 parts | 9 parts |
| glycerol | co-solvent | 3 parts | 3 parts | 3 parts | 3 parts | 3 parts | 3 parts |
| SDP2000[a] | pigment | 5 parts | 5 parts | 5 parts | 5 parts | 5 parts | 5 parts |
| Surfynol ® 465 | surfactant | 0.5 part | 0.5 part | 0.5 part | 0.5 part | 0.5 part | 0.5 part |
| Joncryl ® HPD671[b] | polymer | | 1 part | | | | |
| Joncryl ® HPD690[b] | polymer | | | 1 part | | | |
| Joncryl ® HPD675[b] | polymer | | | | 1 part | | |
| Joncryl ® HPD694[b] | polymer | | | | | 1 part | |
| Reactol ® 5145[c] | polymer | | | | | | 1 part |
| water | water | 72.5 parts | 71.5 parts | 71.5 parts | 71.5 parts | 71.5 parts | 71.5 parts |

[a]surface-modified black pigment available from Sensient Colors Inc.
[b]styrene acrylic dispersant resin available from BASF
[c]polyester resin available from Hexion Speciality Chemicals Assessment of Ink Resolubility A Memjet® inkjet device (as described above) was observed at ×400 magnification and an imaged record taken (A). The device was then primed with a fluid before drying at 120° C. for 15 minutes. The nozzles and heaters were then observed at ×400 magnification and an imaged record made (B).

The device was then washed with colorless ink vehicle before allowing standing in the ink vehicle for 30 minutes. A final rinse was then given and the devices dried using a flow of nitrogen.

The nozzles and heaters were then observed at ×400 magnification before a third imaged record was taken (C).

Records (A), (B) and (C) were compared and the cleanliness of the nozzles and heaters in record (C) rated using the following scale

TABLE 3

| Scoring for resolubility of dried ink films | |
|---|---|
| Score | Description |
| 1 | No change between records (B) and (C) |
| 2 | Marginal change between records (B) and (C) |
| 3 | Nozzles and heaters in (C) are significantly cleaner than record (B) |
| 4 | Nozzles and heaters in record (C) look similar to those in (A) |

Assessment of Kogation

A Memjet device was primed with the fluid and a longevity study started. The study was run for 20 million actuations and the kogative build up at 10 million and 20 million was assessed using optical microscopy (×400). It was found the kogative build-up at 20 million actuations matched that of 10 million actuations and therefore the kogation at 10 million actuations was used to rate the fluids. Table 4 describes the scale used.

TABLE 4

| Scoring for kogative build-up | |
|---|---|
| Score | Description |
| 1 | Heavy deposits over most or all of the heater |
| 2 | Moderate deposits over most of the heater |
| 3 | Regions of moderate deposit over the heater |
| 4 | Light deposits on heater |
| 5 | Heater clean and free of deposits |

The resolubility and kogation scores were used to assess each of the ink formulations described in Tables 1 and 2. The results are shown in Table 5.

TABLE 5

| Comparison of resolubility and kogation for each ink | | | | | |
|---|---|---|---|---|---|
| Ink | Resolubility Score | Kogation Score | Polymer Class | $T_g$ (° C.) | Av (mgKOH/g) |
| Ex. 1 | 4 | 4 | styrene acrylic | 15 | 141 |
| Ex. 2 | 4 | 4 | styrene acrylic | 15 | 141 |
| Ex. 3 | 2 | 3 | styrene acrylic | 15 | 141 |
| Ex. 4 | 2 | 3 | styrene acrylic | 88 | 243 |
| Comp. Ex. 1 | 1 | 1 | polymer free | — | — |
| Comp. Ex. 2 | 1 | 1 | styrene acrylic | 128 | 214 |
| Comp. Ex. 3 | 1 | 1 | styrene acrylic | 102 | 240 |
| Comp. Ex. 4 | 2 | 1 | styrene acrylic | 103 | 222 |

TABLE 5-continued

Comparison of resolubility and kogation for each ink

| Ink | Resolubility Score | Kogation Score | Polymer Class | $T_g$ (° C.) | Av (mgKOH/g) |
|---|---|---|---|---|---|
| Comp. Ex. 5 | 1 | 1 | styrene acrylic | 101 | 200 |
| Comp. Ex. 6 | 1 | 2 | polyester | 140 | 130 |

From Table 5, it can be seen that only those inks containing a styrene acrylic polymer having a $T_g$ of <100° C. gave the highest kogation scores (i.e. less heater kogation). In inks containing no polymer or a polymer having a $T_g$ of >100° C., kogation of the heater elements was generally heavy after 10 million actuations. These results confirm that the addition of acrylic polymers having a $T_g$ of <100° C. to inkjet inks has a significant beneficial effect in terms of reducing heater kogation. The use of a specific type of polymer dispersant to reduce heater kogation is surprising, given that non-volatile polymer dispersants were hitherto understood to be responsible for kogation in pigment-based inks.

It will, of course, be appreciated that the present invention has been described by way of example only and that modifications of detail may be made within the scope of the invention, which is defined in the accompanying claims.

The invention claimed is:

1. A method of minimizing kogation of a heater element in a thermal inkjet printhead, said method comprising the steps of:

(i) supplying an inkjet ink to at least one nozzle chamber of the printhead; and (ii) actuating a heater element in the nozzle chamber so as to heat a portion of the ink to a temperature sufficient to form a bubble therein, thereby causing a droplet of ink to be ejected from a nozzle opening associated with the nozzle chamber, wherein said ink comprises a styrene-acrylic copolymer having a glass transition temperature (Tg) in the range of 5 to 30° C. and an acid value in the range of 100 to 180 mgKOH/g, said styrene-acrylic copolymer minimizing kogation of said heater element.

2. The method of claim 1, wherein said heater element is actuated at least 10 million times and exhibits less kogation compared to an ink in which said acrylic polymer is absent.

3. The method of claim 1, wherein said ink comprises a pigment.

4. The method of claim 3, wherein said pigment is a self-dispersing surface-modified pigment.

5. The method of claim 1, wherein said ink vehicle is an aqueous-based ink vehicle.

6. The method of claim 5, wherein said ink vehicle comprises at least one solvent present in an amount ranging from 5 wt % to 40 wt %; at least one surfactant present in an amount ranging from 0.1 wt % to 5 wt %; and water.

7. The method of claim 6, wherein the at least one solvent is selected from the group consisting of: ethylene glycol, glycerol and 2-pyrollidone.

8. The method of claim 1, wherein said pigment is present in an amount ranging from 0.01 to 25 wt % and said acrylic polymer is present in an amount ranging from 0.1 to 15 wt %.

9. An inkjet ink for minimizing kogation of a heater element in a thermal inkjet printhead, said ink comprising:

an ink vehicle;

a colorant; and a styrene-acrylic copolymer having a glass transition temperature ($T_g$) in the range of 5 to 30° C. and an acid value in the range of 100 to 180 mgKOH/g.

10. The inkjet ink of claim 9, wherein said colorant is a surface-modified pigment.

11. The inkjet ink of claim 10, wherein said surface-modified pigment comprises surface sulfonate groups or surface carboxylate groups.

12. An inkjet printer comprising a thermal inkjet printhead in fluid communication with an ink reservoir containing the inkjet ink according to claim 9.

13. The inkjet printer of claim 12, wherein said thermal inkjet printhead comprises a plurality of nozzle chambers containing said ink, each nozzle chamber comprising a heater element suspended or embedded in said nozzle chamber, said heater element being configured for heating a portion of said ink to a temperature sufficient to form a bubble and thereby eject a droplet of said ink from said nozzle chamber.

* * * * *